US008800106B2

(12) United States Patent
Bilek et al.

(10) Patent No.: US 8,800,106 B2
(45) Date of Patent: Aug. 12, 2014

(54) FLOOR CLEANING DEVICE WITH MULTIPLE AGITATORS

(75) Inventors: Greg Bilek, Doylestown, OH (US); David Cotsmire, North Canton, OH (US); Jeff Louis, Akron, OH (US); Ronald Kintz, North Canton, OH (US); Kevin Thomas, Richmond, VA (US)

(73) Assignee: Techtronic Floor Care Technology Limited, Tortola (VG)

( * ) Notice: Subject to any disclaimer, the term of this patent is extended or adjusted under 35 U.S.C. 154(b) by 601 days.

(21) Appl. No.: 12/418,366

(22) Filed: Apr. 3, 2009
(Under 37 CFR 1.47)

(65) Prior Publication Data

US 2009/0265878 A1 Oct. 29, 2009

Related U.S. Application Data

(60) Provisional application No. 61/042,098, filed on Apr. 3, 2008.

(51) Int. Cl.
*A47L 5/30* (2006.01)

(52) U.S. Cl.
USPC ..... 15/389; 15/384; 15/385

(58) Field of Classification Search
USPC ..... 15/384, 385, 389
See application file for complete search history.

(56) References Cited

U.S. PATENT DOCUMENTS

| | | | | |
|---|---|---|---|---|
| 2,536,902 | A * | 1/1951 | Beckett | 15/345 |
| 2,558,864 | A * | 7/1951 | Malchus et al. | 15/333 |
| 2,834,034 | A * | 5/1958 | Angell | 15/79.2 |
| 3,409,933 | A * | 11/1968 | Larsson | 15/364 |
| 5,008,973 | A | 4/1991 | Worwag | |
| 5,056,175 | A | 10/1991 | Stein et al. | |
| 5,406,673 | A | 4/1995 | Bradd et al. | |
| 5,802,665 | A | 9/1998 | Knowlton et al. | |
| 5,867,857 | A | 2/1999 | Crouser et al. | |
| 6,009,593 | A | 1/2000 | Crouser et al. | |
| 6,189,174 | B1 | 2/2001 | Crouser et al. | |
| 6,467,122 | B2 | 10/2002 | Lenkiewicz et al. | |
| 6,640,386 | B2 | 11/2003 | Morgan et al. | |

(Continued)

FOREIGN PATENT DOCUMENTS

| | | |
|---|---|---|
| BE | 530839 | * 10/1957 |
| DE | 289556 | 1/1916 |
| WO | 2005096907 | 10/2005 |
| WO | 2009/042663 | 4/2009 |

OTHER PUBLICATIONS

PCT/US09/39521 Search Report and Written Opinion, 9 pages, dated Jun. 3, 2009.

(Continued)

*Primary Examiner* — Bryan R Muller
(74) *Attorney, Agent, or Firm* — Michael Best & Friedrich LLP

(57) ABSTRACT

An agitator arrangement for a floor cleaning machine is disclosed including various multi-agitator configurations or one agitator configuration with a plurality of brushes with bristle bundles for rotation of the brushes about an approximate vertical axis with a plurality of stationary downwardly projecting, bristle bundles arranged in at least one row approximately side by side with or without an offset. In particular, agitator assemblies having multiple brushes that rotate in approximately a horizontal and approximately a vertical axis or that rotate at different speeds and torque. Other configurations may include multi-row multiple vertical axis agitators.

13 Claims, 13 Drawing Sheets

(56) References Cited

U.S. PATENT DOCUMENTS

| | | | | |
|---|---|---|---|---|
| 6,647,578 | B2 | 11/2003 | Morgan et al. | |
| 7,059,004 | B2 | 6/2006 | Mitchell et al. | |
| 7,225,501 | B2 | 6/2007 | Gordon et al. | |
| 7,228,593 | B2 | 6/2007 | Conrad | |
| 7,299,521 | B2 | 11/2007 | Theiss, Jr. et al. | |
| 7,533,442 | B2 | 5/2009 | Morgan et al. | |
| 2003/0037409 | A1* | 2/2003 | Lee | 15/385 |
| 2003/0051308 | A1 | 3/2003 | Morgan et al. | |
| 2003/0196294 | A1 | 10/2003 | Conrad | |
| 2004/0025270 | A1 | 2/2004 | Mitchell et al. | |
| 2005/0034266 | A1* | 2/2005 | Morgan et al. | 15/354 |
| 2005/0155169 | A1* | 7/2005 | Cheah et al. | 15/42 |
| 2006/0076035 | A1* | 4/2006 | McGee et al. | 134/6 |
| 2006/0101604 | A1* | 5/2006 | Frederick et al. | 15/319 |
| 2006/0101612 | A1 | 5/2006 | Gordon et al. | |
| 2006/0156498 | A1 | 7/2006 | Venard et al. | |
| 2006/0236492 | A1 | 10/2006 | Sudo | |
| 2007/0234492 | A1* | 10/2007 | Svendsen et al. | 15/21.1 |
| 2007/0261193 | A1 | 11/2007 | Gordon et al. | |
| 2009/0165822 | A1* | 7/2009 | Kintz et al. | 134/18 |

OTHER PUBLICATIONS

CN2009801207158 Second Office Action dated Oct. 10, 2013 (14 pages with English translation).

CN2009801207158 Search Report dated Dec. 3, 2012 (2 pages—English translation).

First Office Action from the State Intellectual Property Office of China for Application No. CN2009801207158 dated Dec. 3, 2012 (14 pages—English translation).

EP09728975.5 Extended European Search Report dated May 13, 2013 (6 pages).

* cited by examiner 212
204A
214
204B
212
214
204D
212
204E
212
214
204F
212
214
204G
212
214
204H
212
222
224
202
204C
212
214
204B
212
214
204D FIG. 10
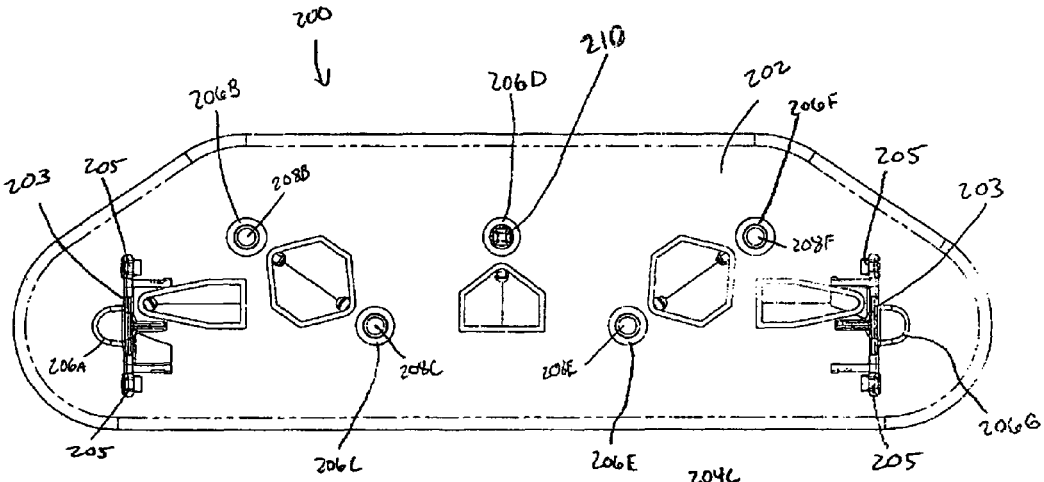
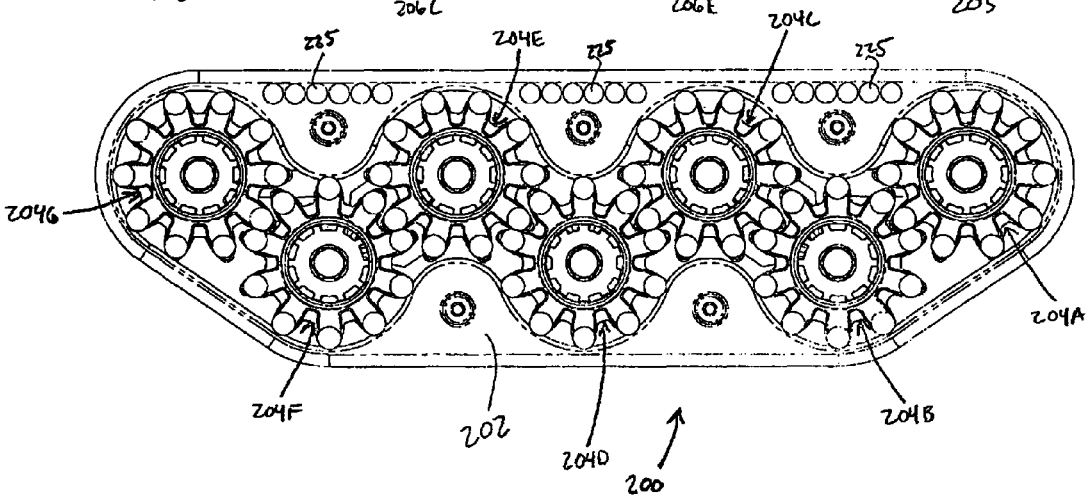
FIG. 11

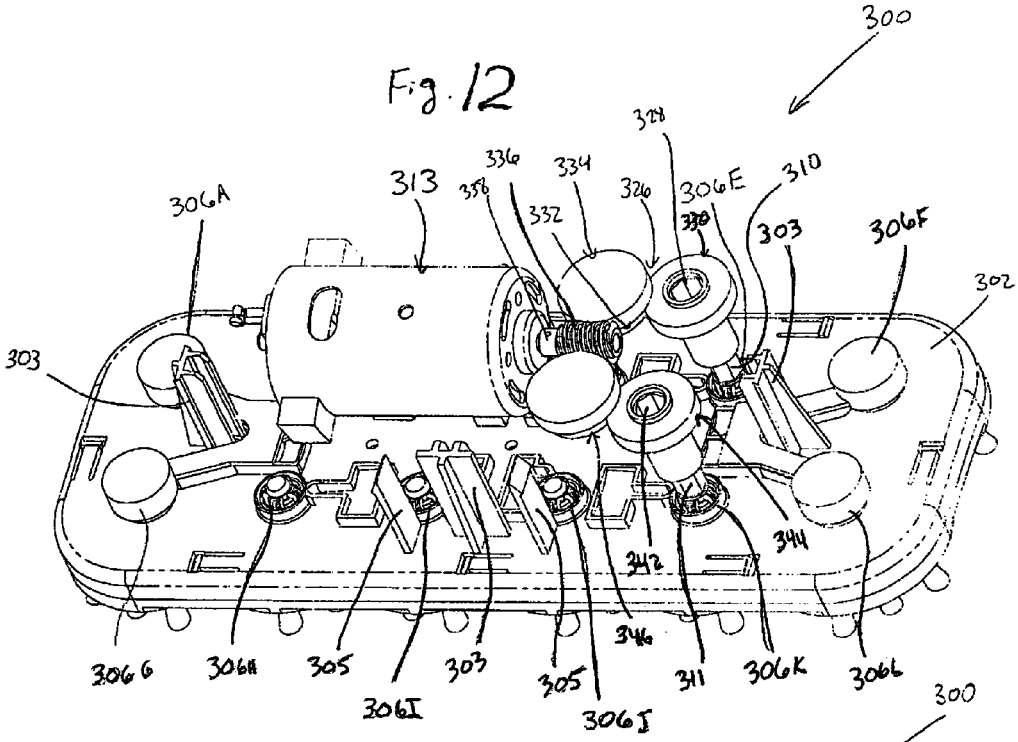
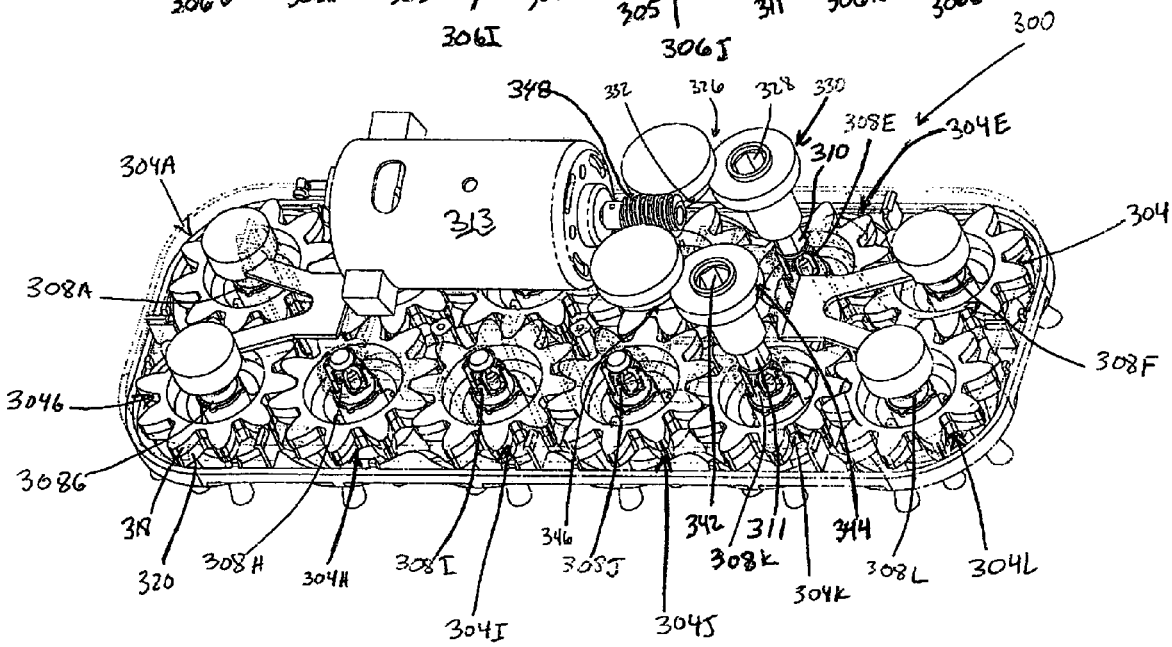
Fig. 13

FLOOR CLEANING DEVICE WITH MULTIPLE AGITATORS

This application claims the benefit to U.S. provisional patent application entitled "FLOOR CLEANING DEVICE WITH MULTIPLE AGITATORS" having Ser. No. 61/042,098 filed Apr. 3, 2008, the entire disclosure of which is hereby incorporated by reference.

TECHNICAL FIELD

The present disclosure relates generally to floor cleaning machines. More specifically, the disclosure relates to a floor cleaning machine including a plurality of agitators or brushes that contact a floor surface.

TECHNICAL CONSIDERATIONS FOR THE DISCLOSURE

In recent years, home or personal extraction cleaning devices have become a popular alternative to professional carpet cleaning services. Such devices apply liquid cleaning fluid to carpet, or other floor surfaces, agitate the carpet to dislodge dirt, stains and debris, and then remove the liquid-wetted material from the carpet or floor surface using vacuum suction.

Though such devices are effective, several drawbacks exist. First, due to the design and orientation of certain cleaning devices, the commonly known "sweeper track" is not created during cleaning. Though the lack of "sweeper tracks" may not bear on actual cleaning effectiveness, consumers prefer the groomed look evidenced by the presence of a sweeper track. Further, prior art extraction devices do not provide enough agitation of the liquid cleaning fluid deposited on a carpet or other floor surface. Thus, the consumer is forced to repeatedly draw the extractor device over soiled areas in order to achieve a thorough cleaning.

Thus, there exists a need in the art for an agitator arrangement that provides a groomed appearance upon completion of cleaning. Further, there exists a need in the art to provide an extractor cleaning device that quickly and effectively agitates the carpet or other floor surface in order to enhance cleaning effectiveness.

SUMMARY

The present disclosure in one embodiment pertains to a floor cleaning machine that overcomes the aforementioned shortcomings includes a vacuum source, a base module, a suction inlet mounted to the base housing, at least one motor mounted to the base housing, at least one agitator brush supported by the base module and in fluid communication with the suction inlet and with the vacuum source. The at least one agitator brush is operably connected with the at least one motor for rotation of a plurality of brushes approximately around the vertical axis to the floor surface to be cleaned. The plurality of brushes can be arranged in one or two rows laterally within or around the suction inlet for contact of the bristles of the brushes with the surface of the floor to be cleaned. When there is just one row of a plurality of brushes there are present at least additional bristle bundles in at least one row arranged side by side projecting downwardly from the front of the suction inlet to be in front of the row of rotatable brushes.

Another example of a floor cleaning machine that overcomes the aforementioned shortcomings includes a vacuum source, a base module, a suction inlet mounted to the base housing, at least one motor mounted to the base housing, at least one first agitator brush supported by the base housing, and at least one second agitator brush supported by the base housing. The suction inlet is in fluid communication with the vacuum source. The at least one first agitator brush is operably connected with the at least one motor. The at least one first agitator brush rotates about a first axis. The at least one second agitator brush is operably connected with the at least one motor. The at least one second agitator brush rotates about a second axis, which is generally perpendicular to the first axis.

A further example of a floor cleaning machine that overcomes the aforementioned shortcomings includes a vacuum source, a suction nozzle, a base housing supporting the suction nozzle, a motor mounted to the base housing, at least one first agitator brush disposed in the base housing, and at least one second agitator brush disposed in the base housing. The suction nozzle includes a suction inlet in fluid communication with the vacuum source. The at least one first agitator brush is operably connected with the motor for rotation at a first speed. The at least one second agitator brush is operably connected with the motor for rotation at a second speed, which is less than the first speed. Additionally, the at least one first agitator brush can be driven at a first torque and the at least one second agitator brush can be driven at a second torque, which is greater than the first torque.

A carpet extractor that overcomes the aforementioned shortcomings includes a vacuum source, a base housing, a suction inlet supported by the base housing, a recovery tank supported by the base housing, a motor mounted to the base housing, a first agitator brush operably connected with the motor and supported by the base housing, and a plurality of second agitator brushes operably connected with the motor and supported by the base housing. The suction inlet is in fluid communication with the vacuum source. The recovery tank is also in fluid communication with the vacuum source. The first agitator brush is disposed at a location rearward from the suction inlet. The first agitator brush rotates about an approximately horizontal axis. The plurality of second agitator brushes is disposed at a location rearward from the suction inlet. The second agitator brushes each rotate about an approximately vertical axis.

BRIEF DESCRIPTION OF THE DRAWINGS

With reference now to the drawings of suitable embodiments of the present disclosure which are for illustrative purposes only:

FIG. 10 is a top view of the alternative brush assembly of FIG. 7;

FIG. 11 is a bottom view of the alternative brush assembly of FIG. 7;

FIG. 12 is an isometric view of another alternative brush assembly according to another embodiment of the present disclosure;

FIG. 13 is a cut-away isometric view of the alternative brush assembly of FIG. 12;

DETAILED DESCRIPTION OF ILLUSTRATIVE EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. In addition other than where otherwise indicated, all numbers expressing quantities of physical properties and parameters and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass the beginning and ending range values and any and all sub-ranges subsumed therein.

Figure 1:
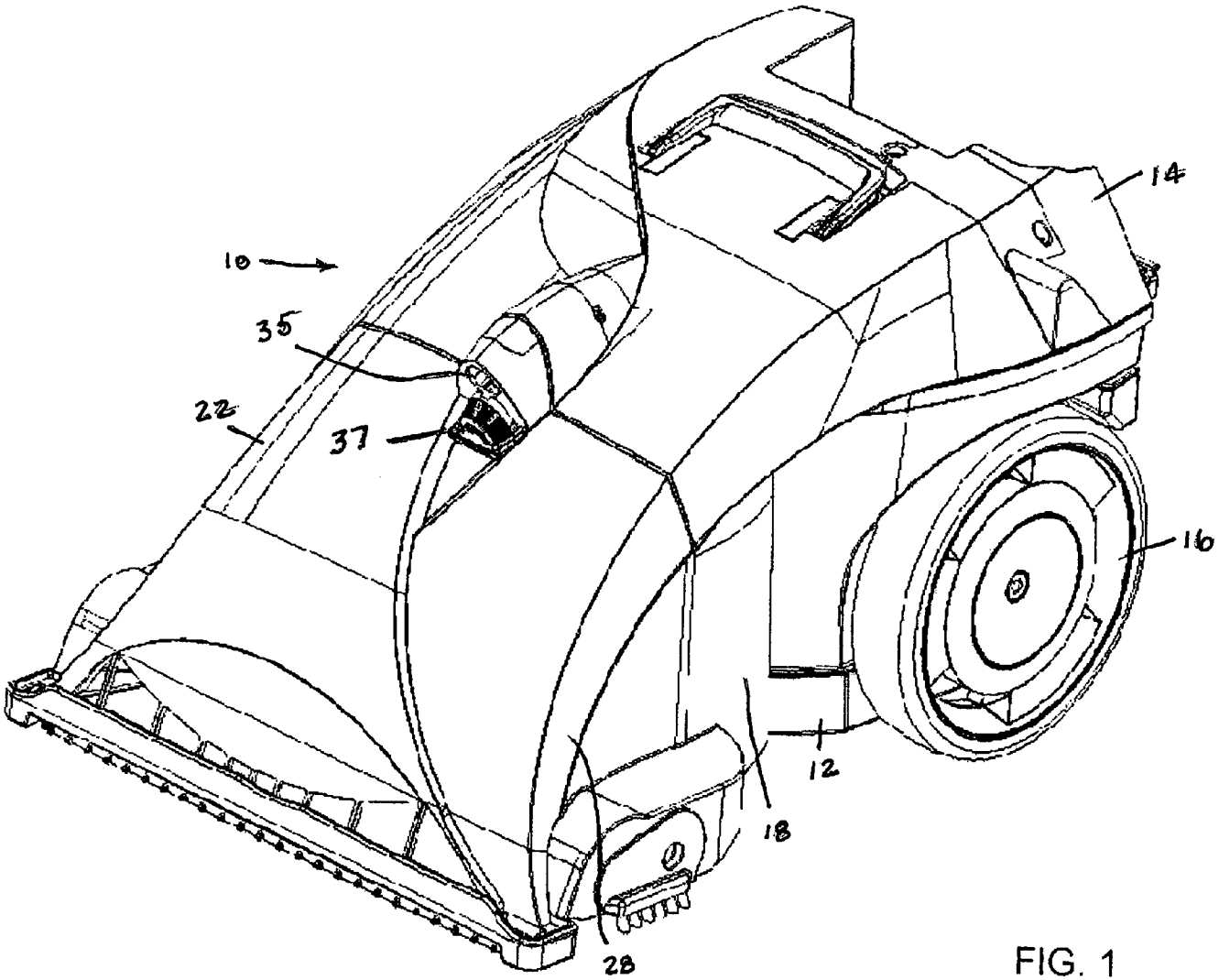
FIG. 1 is an isometric view of a base module of a floor cleaning machine according to one embodiment of the present disclosure.

Embodiments of the disclosure relate to floor cleaning appliances suitable examples are depicted in the drawings where similar parts and elements have the same reference number where appropriate. FIG. 1 shows a floor cleaning machine in the form of a base module 10 for an upright extractor style carpet cleaner. Any upper portion for an upright carpet extractor may be suitable for use in combination with the herein described base module 10, for example U.S. Pat. No. 5,406,673 issued on Apr. 18, 1995, titled "Tank Carry Handle and Securement Latch", the contents of which are hereby incorporated by reference. Moreover, the components and arrangements disclosed herein can be utilized with other floor cleaning machines including vacuum cleaners (canister and upright), sweepers, and the like.

Figure 2:
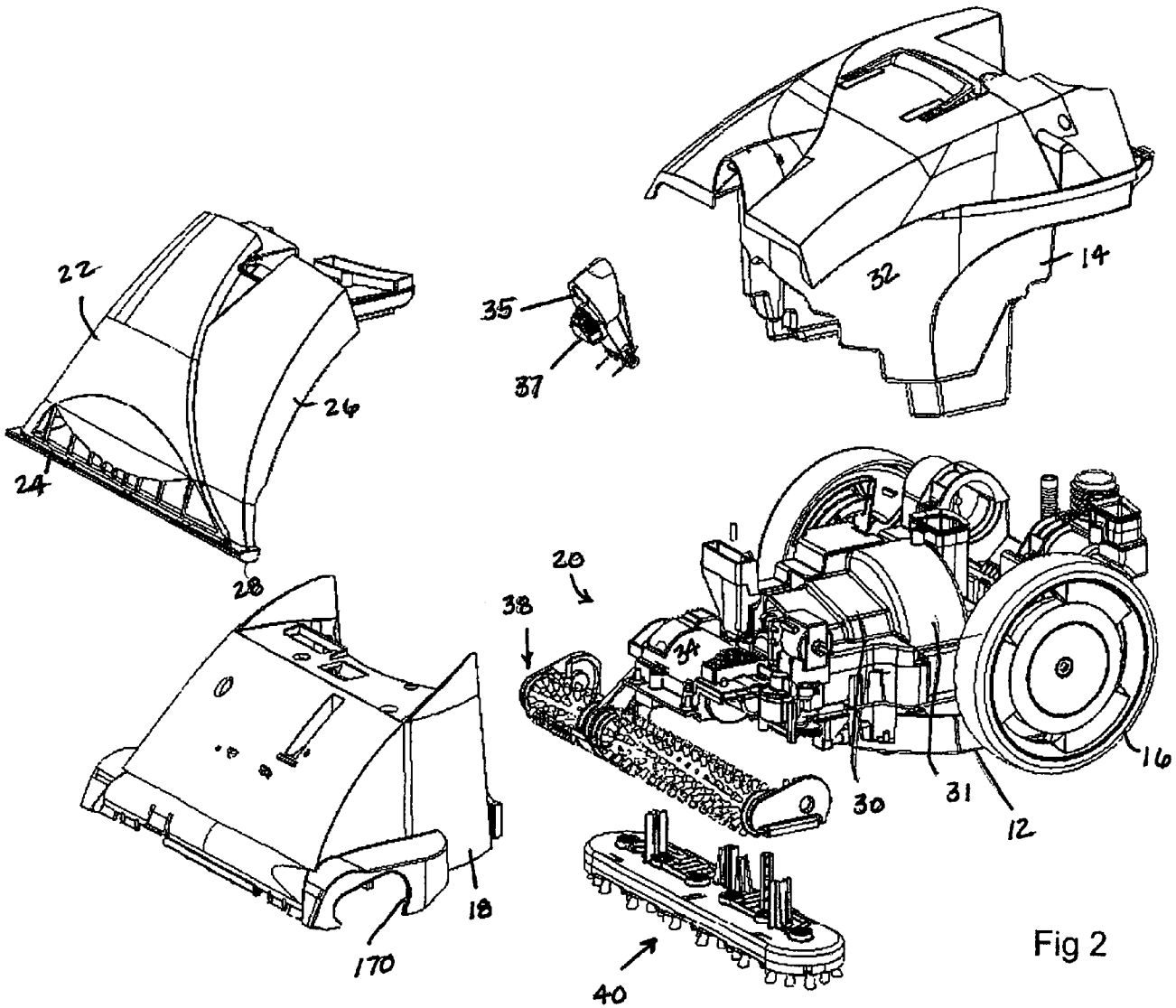
FIG. 2 is an exploded perspective view of the base module shown in FIG. 1.

Base module 10 can have as shown in FIG. 1 a lower housing 12 and an upper housing 14. However it should be understood that the base module can be a nearly flat platform or tray with or with out one or more indentations or inserts to hold components on the base module. A pair of wheels 16 rotatably couple to lower housing 12 to allow for reduced friction movement along a floor surface. With reference now also to FIG. 2, a front housing 18 is positioned forwardly of lower and upper housings 12 and 14 and is provided to support and protect an agitator assembly 20. In the depicted embodiment, lower housing 12, upper housing 14 and front housing 18 make up a base housing for the base module 10. Front housing 18 further supports a suction nozzle 22 having a suction inlet 24. Additionally, front housing 18 supports an exhaust nozzle 26 having an exhaust outlet 28.

With reference to FIG. 2, during use, a vacuum source 30 is actuated that draws fluid through suction inlet 24, into suction nozzle 22, and into a recovery tank 32. The fluid can be comprised of air or air with moisture and/or remnants of liquid cleaner, rinses and/or water deposited on the surface of the floor to be cleaned. In the recovery tank, the moisture, and/or liquids and dirt can be removed and the air is drawn through vacuum source 30. The exhaust air is then communicated to exhaust nozzle 26 to thereafter be directed onto the floor surface via exhaust outlet 28. As noted above, front housing 18 encloses and supports the agitator assembly 20. Agitator assembly 20 is provided to agitate liquid cleaning products that are deposited on a floor surface, thereby increasing the cleaning effectiveness of the floor cleaner. The deposition of these products can be through any distribution arrangement used for extractor type floor cleaning appliances. For example, one such suitable liquid distribution system is disclosed in co-pending U.S. patent application Ser. No. 12/236,811 filed Sep. 24, 2008 entitled "EXTRACTION CLEANING APPARATUS and published as a PCT Patent Application No. WO 2009/042663, which is hereby incorporated herein in its entirety and especially for the liquid distribution system disclosed therein. Additionally liquid can be deposited on the floor surface to be cleaned in a localized area through a sprayer 37, which can have a mode selector to change the mode of operation for the spray, e.g., fan-shaped spray mode, spot spray mode, rinse only mode, etc. Additionally located adjacent to the sprayer 37 to assist in the user seeing the spray pattern a light source 35 can be mounted to the base module.

Figure 3:
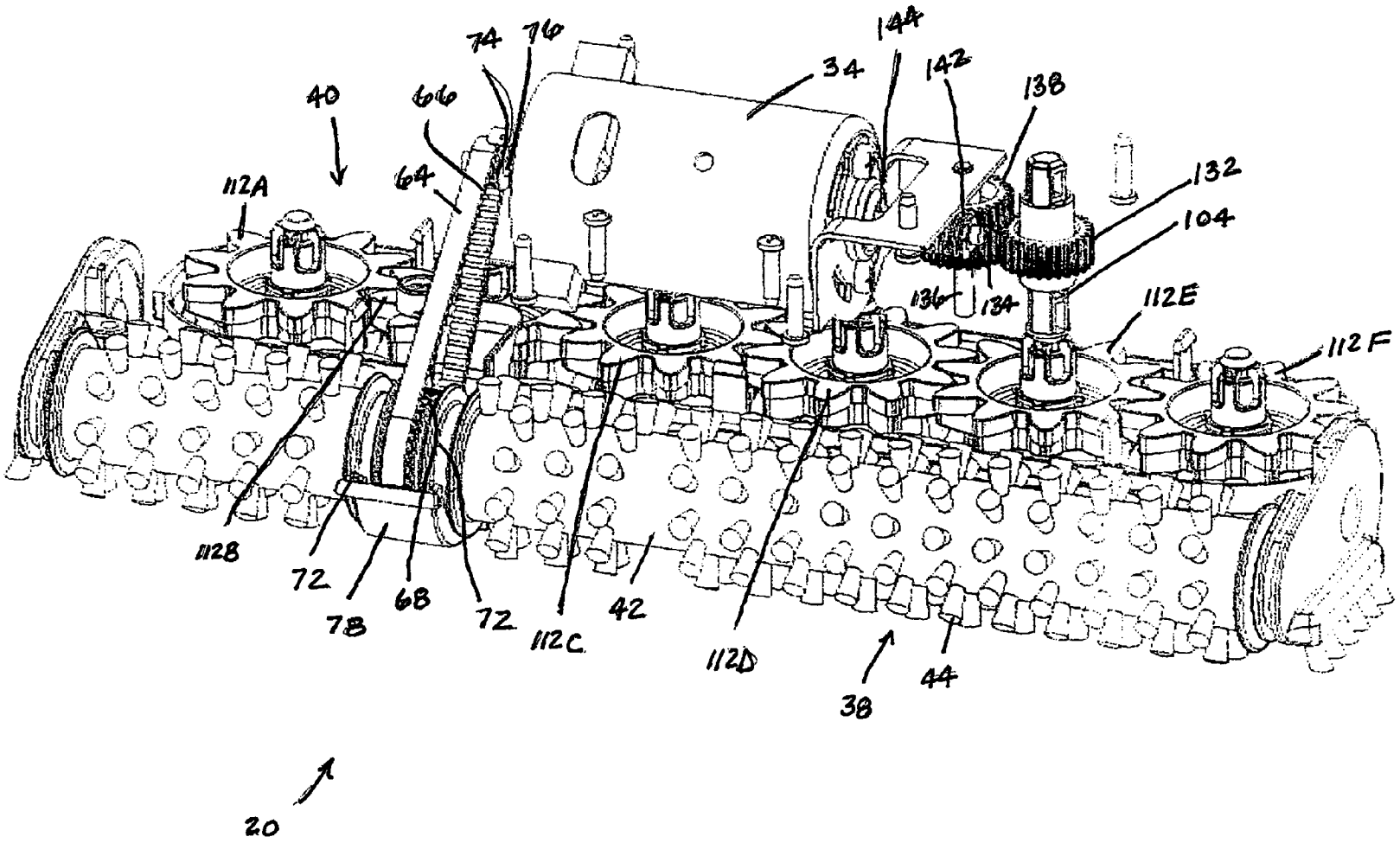
FIG. 3 is an enlarged upper perspective view of the forward side of an agitator assembly of the base module of FIG. 1 with a protective housing removed.

With reference to FIG. 3, agitator assembly 20 includes an electric motor 34 that may be selectively actuated. Motor actuation may be performed manually by the user or may be automatically controlled by on-board computer circuitry. A power transfer mechanism mechanically interconnects motor 34 to a first brush assembly 38 and a second brush assembly 40. In the depicted embodiment, motor 34 drives brush assemblies 38 and 40 simultaneously. Alternatively, more than one motor can be provided, e.g. a first motor can drive first brush assembly 38 and a second motor can drive second brush assembly 40.

First brush assembly 38 can be positioned forward of second brush assembly 40 and is adapted to contact a floor surface such as a carpet. In the depicted embodiment, both brush assemblies 38 and 40 are positioned rearwardly from the suction inlet 22 and the exhaust outlet 28. First brush assembly 38 includes at least one agitator brush, which in the depicted embodiment is an elongated brushroll 42, having a first (approximately horizontal) axis of rotation in relation to the surface being cleaned. In the depicted embodiment only one agitator brush is depicted as part of first brush assembly 38; however, more than one agitator brush could be provided such that each brush is coupled to motor 34 (or separate motors). The brushroll can have an approximately cylindrical shape, if so desired. With reference to FIG. 3, brushroll 42 includes an outer surface carrying a plurality of bristle tufts or bundles 44 thereon. In the present embodiment multiple rows of such bristle tufts 44 are used. Alternatively, one or more serpentine row of bristle tufts can be provided. It should be appreciated that other configurations may be employed, such as one or more lines of bristles secured to an elongated roller.

Figure 4:
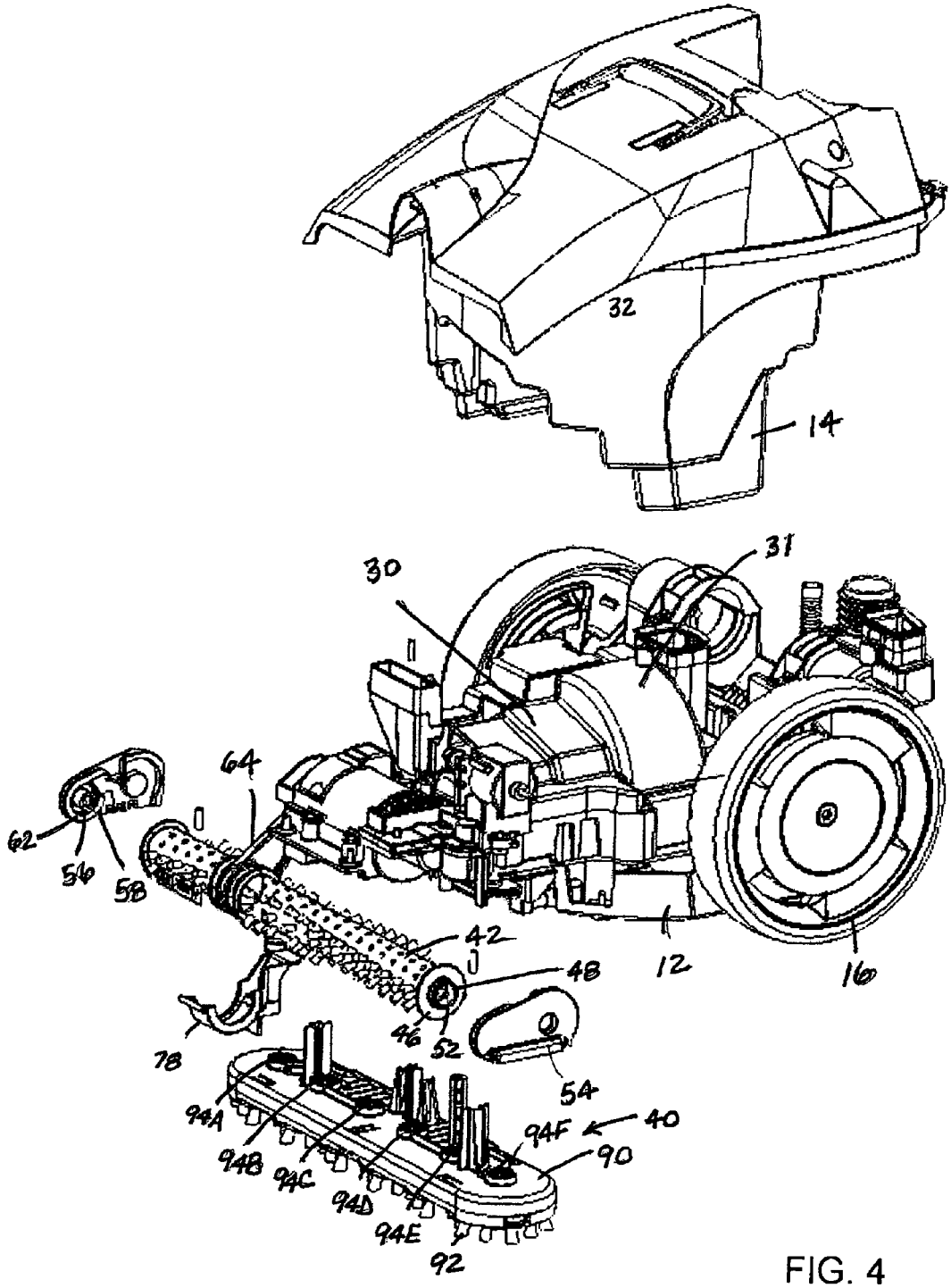
FIG. 4 is an enlarged exploded perspective view of the base module of FIG. 1.

As seen in FIG. 4, brushroll 42 includes radially projecting circular flanges 46 on opposed ends. Axially outward of flanges 46, each end of the brushroll 42 includes a cylindrical boss 48 and a post 52 positioned concentric within boss 48. Boss 48 and post 52 are received by end brackets 54 which act as a retaining member for retaining brushroll 42 to the base housing. End brackets 54 include an inwardly protruding J-shaped projection 56 and a central boss 58 having a central bore 62. Thus, boss 48 on cylindrical roller 42 is received between J-shaped protrusion 56 and central boss 58. Post 52 on cylindrical roller 42 is received in bore 62. In this manner cylindrical roller 42 is carried by end brackets 54 and is free to rotate with respect thereto.

With reference back to FIG. 3, cylindrical roller 42 is rotated by a belt 64. In the disclosed embodiment, the belt includes a plurality of inwardly facing teeth 66 that intermesh with a toothed portion 68 of cylindrical roller 42. Thus, a positive drive with no belt slippage is disclosed. A pair of guides 72, in the form of raised radial projections, is provided on each side of toothed portion 68 to guide belt 64 and keep it positioned on toothed portion. Belt 64 is driven by a spur gear 74 connected fast with an output shaft 76 of motor 34. Spur gear 74 includes a plurality of teeth on the radial outer circumferential surface thereof that intermesh with teeth 66 of belt 64. In this manner, rotation of spur gear 74 causes rotation of cylindrical roller 42. Belt 64, when it contacts the brushroll 42, is protected by a shield 78 that includes a generally U-shaped cross section and a generally J-shaped overall profile.

Figure 5:
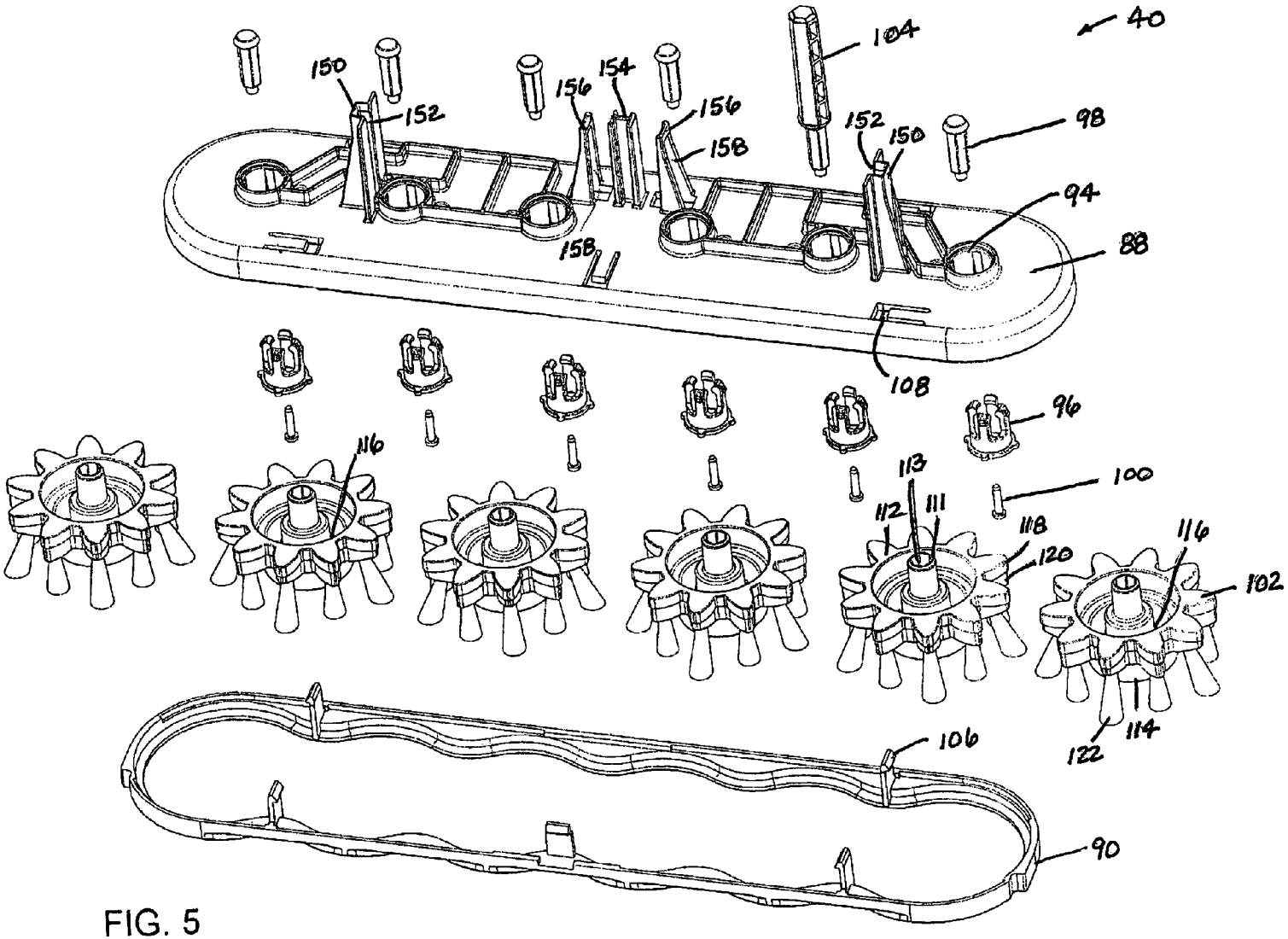
FIG. 5 is an enlarged exploded view of a brush assembly for the agitator assembly of FIG. 3.

With reference to FIG. 5, second brush assembly 40 includes an upper housing 88 and a lower housing 96 that connect together and house a plurality of brushes 102. In the depicted embodiment, upper housing 88 includes six spaced apart openings 94 each receiving a cylindrical bearing 96. Rotatably received within bearings 96 are axial shafts 98, which are retained by fasteners 100 connected with brushes 102. One axle connects with an axle extension 104, for purposes to be described below. Further, it should be appreciated that more or less than the depicted number of brushes may be employed. The lower housing 90 includes flexible tabs 106 that are received in corresponding slots 108 in upper housing 88 for connecting the upper housing to the lower housing and for retaining the several brushes 102 between the housings.

Each brush 102 includes and/or connects with a spur gear 112 having, for example, ten teeth. With reference to FIG. 3, when gear 112E rotates, which is connected with axle extension 104, all other gears 112A, 112B, 112C, 112D, and 112F rotate therewith. Thus, each brush 102 has a vertical axis of rotation with respect to the surface being cleaned. In this connection, attention is drawn to U.S. Pat. No. 6,009,593 the subject matter of which is incorporated hereinto by reference, in its entirety. With reference back to FIG. 5, a center hub 111 of spur gear 112 forms a hollow downwardly projecting cup 114 having a plurality of openings 116 circumscribing the bottom thereof. Center hub 111 includes a bore 113, which is non-circular (such as, for example, hexagonal) in a cross-section taken normal to the vertical rotational axis. Bore 113 receives axle 98.

Each spur gear 112 has an upper tooth profile 118 and a lower tooth profile 120 which approximates upper profile 118; however, lower profile 120 is smaller in size and slightly indented from upper profile 118 forming an offset. In the depicted embodiment, only upper profiles 118 are intended to drivingly engage the corresponding upper tooth profile of the adjacent gear.

Each brush 102 includes bristle bundles 122 extending downwardly from lower tooth profile 120. Each bristle bundle 122 is adapted to contact a floor surface, such as a carpet, wherein the rotating motion of brush 102 draws each bristle bundle 122 along the floor surface to effect cleaning. Bristle bundles 122 may be of a soft texture so that when rotating, and in contact with the surface being cleaned, the bristle bundles bend whereby the bottom of projecting cup 114 can also contact the surface being cleaned. The cleaning solution may then be dispensed through openings 116 and flow directly onto the surface being cleaned. In one or more embodiments, the preferred operational speed of brushes 102 is between about 500 and about 900 RPM for a brush of approximately two inches in diameter.

With reference back to FIG. 3, gear 112E is connected with axle extension 104, having, for example, a hexagon shaped axial cross-section. Shaft extension 104 extends upwardly and is rotationally coupled to a power transfer mechanism that is operably coupled with motor 34. In the illustrated embodiment and with reference to FIG. 6, the power transfer mechanism is housed in a casing, which includes a lower casing section 126 and an upper casing section 128, adapted to contain and protect the gears and moving elements of the power transfer mechanism. Further, casing sections 126 and 128 includes a plurality of bores that receive and rotatably support the various gears that will be hereinafter described.

With reference again to FIG. 3, axle shaft extension 104 extends upwardly from gear 112E, into the casing (not shown in FIG. 3) and is received within a hexagon shaped aperture 130 (see FIG. 6), which could be of another non-circular shape, formed through a driven spur gear 132. Consequently, as driven gear 132 rotates, shaft extension 104 rotates therewith. In turn, rotation of shaft extension 104 causes gear 112E to rotate and through the interaction of gears 112A-112F, all brushes 102 rotate.

Figure 6:
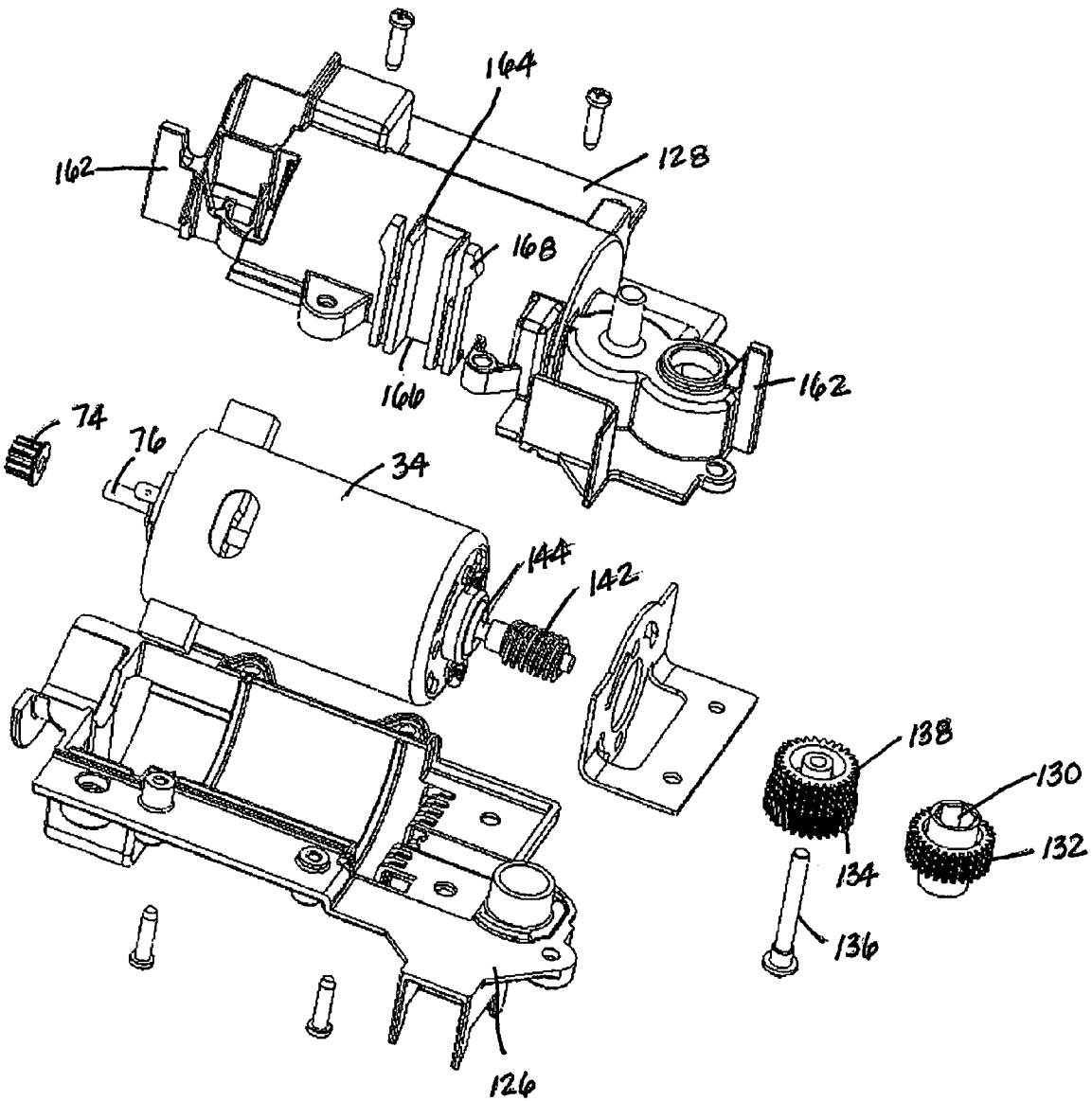
FIG. 6 is an exploded view of a power transfer mechanism housed in the base module of FIG. 1.
Figure 7:
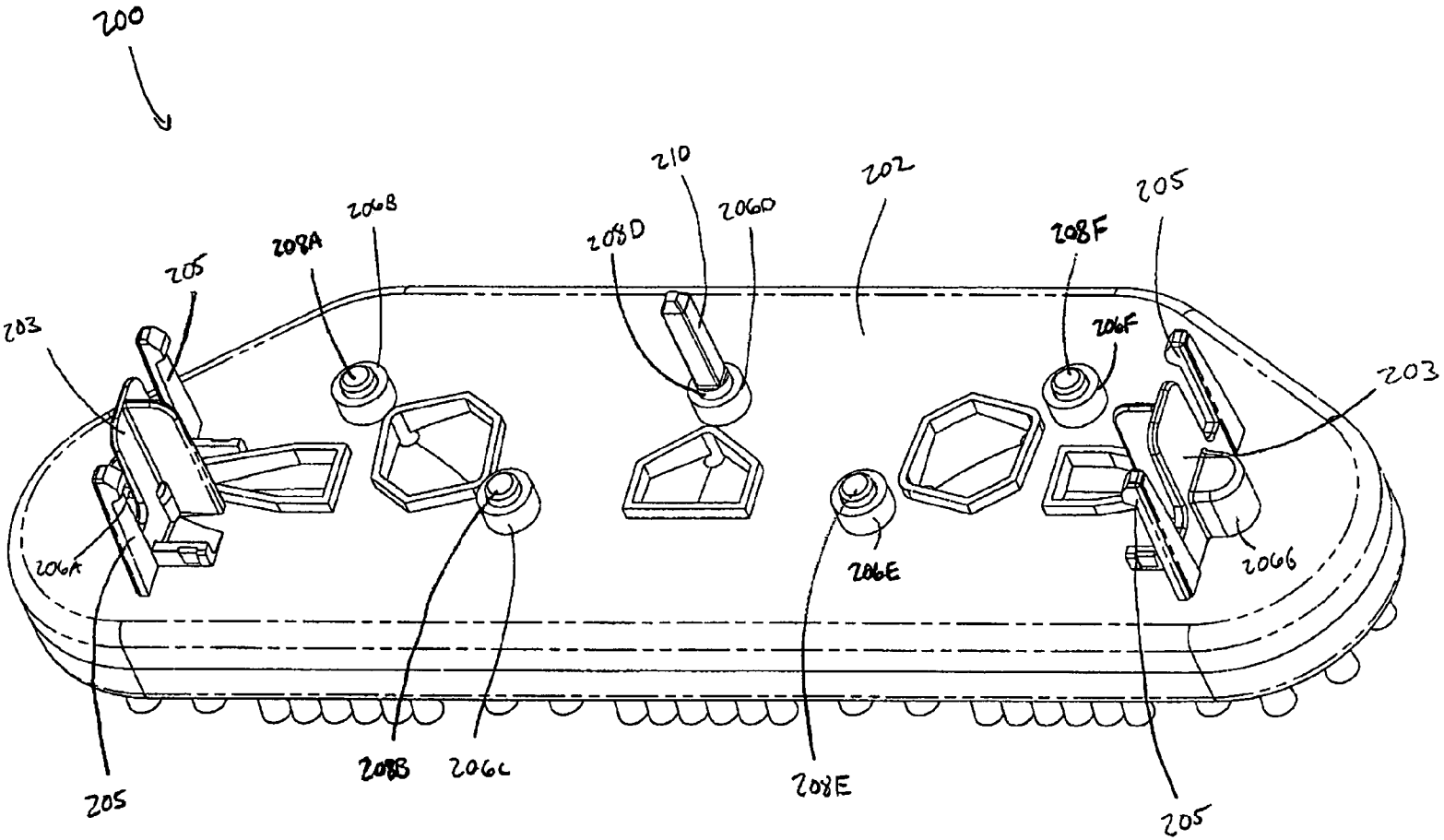
FIG. 7 is an isometric view of an alternative brush assembly according to another embodiment of the present disclosure.

Driven spur gear 132 intermeshes with a first reduction gear 134 which is rotatably received on an axle 136 mounted in casing sections 126 and 128 (FIG. 6). A second reduction gear 138 is coupled to first reduction gear 134, each of which is rotatably received on axle 136. Thus, reduction gears 134 and 138 rotate together on axle 136. Second reduction gear 138 intermeshes with a worm gear 142 that is secured fast to motor shaft 144 so that, when actuated, motor 34 causes worm gear 142 to rotate. Motor shaft 76 and 144 can be the same shaft, if desired. Thus, as worm gear 142 rotates, the second reduction gear 138 rotates. This rotation is transferred to first reduction gear 134, which is in turn transmitted to driven gear 132 which is connected fast with axle shaft extension 104. In this manner, rotation of axle shaft extension 104 causes brushes 102 to rotate.

In the depicted embodiment a single motor simultaneously drives both brush assemblies 38 and 40. In the embodiment depicted in FIGS. 1-6, worm gear 142 that drives second brush assembly 40 is located on one side of the motor and spur gear 74 that drives first brush assembly 38 is located on the other side of the motor. Further, it should be evident that second brush assembly 40 is driven relatively slower, and, thus, with more torque, than the first brush assembly 38. This is due in large part to the use of a worm gear, and connecting gears which achieve a reduced rotational speed and, thus, greater torque. Of course any conventional gear train could be used to achieve this effect. Likewise, the first brush assembly rotates relatively fast because of the direct belt drive arrangement.

When used, the above arrangement will effectively clean a surface and leave the carpet with a groomed, "sweeper track" look. Further, the inclusion of agitators that rotate along different axes, such as one approximately along the horizontal axis and the other approximately along the vertical axis may provide improved cleaning effectiveness for the disclosed floor cleaning machine.

Agitator assemblies 38 and 40 may collect and retain dirt, hair and other debris after multiple uses. From time to time, it may be desirable to remove and clean the agitator assemblies to ensure proper performance. Agitators are most easily cleaned when removed completely from the cleaning device.

Referring to FIG. 5, second brush assembly 40 includes upwardly projecting outer alignment posts 150 that project upwardly from upper housing 38 and each include a vertically extending elongate channel 152. A central alignment post 154 also projects upwardly from upper housing 88. Retaining clips 156 (a pair of retaining clips are shown in FIG. 5) are disposed on opposite sides of central alignment post 154. Each retaining clip 156 includes a slotted opening 158 that extends in a vertical direction. The outer alignment posts 150, the central alignment post 154 and retaining clips 156 cooperate with components found in the base housing to attach the second brush assembly 40 to the base housing in a selectively detachable manner and allows the second brush assembly 40 to float with respect to the base housing.

With reference to FIG. 6, upper casing 128, which encloses the motor 34, includes elongate outer extensions 162 disposed on opposite ends of upper casing 128. An elongate channel member 164 is centrally located with respect to outer extensions 162 and is disposed on a surface of the casing 128 between the elongate extensions 162. Elongate channel member 164 defines an elongate vertically extending channel 166. Resilient tabs 168 are disposed on opposite sides of the elongate channel member 164.

To attach the second brush assembly 40 within the base housing, the outer alignment posts 152 on upper housing 88 (FIG. 5) cooperate with the outer elongate extensions 162 (FIG. 6) on upper casing 128 and elongate extensions 162 are received in channels 152. Additionally, central alignment post 154 on upper housing 88 (FIG. 5) is received in channel 166 defined by channel member 164 (FIG. 6) and tabs 168 ride within vertically extending slots 158 formed in retaining clips 156.

By having clips 168 (FIG. 6) ride within slotted openings 158 (FIG. 5), the second brush assembly 40 is able to float with respect to the base housing. Moreover, removal of the second brush assembly 40 is accomplished by simply pulling the second brush assembly 40 away from the casings 128 and 126. Moreover, the lower housing 90 can be removed from the upper housing 98 by maneuvering clips 106 with respect to notches 108. Accordingly, brushes 102 can be removed and easily cleaned. Other means for securing the second brush assembly are described in U.S. Pat. Nos. 5,867,857, 6,009, 593, and 6,189,174 which are hereby incorporated by reference in their entireties.

With reference now again to FIG. 4, to remove first brush assembly 38 from the base housing, shield 78 is pivoted away from belt 64. In the present embodiment, shield 78 is secured at one end to front housing 18 (FIG. 1) to allow for pivoting relative motion. The other end may be detachably secured to front housing 18 or can be supported by first brush assembly 38.

End brackets 54 are rotatably connected with brushroll 42. With reference to FIG. 2, front housing 18 includes retaining slots 170 on opposed sides thereof that are adapted to receive end brackets 54. Such end brackets can have a one or more bristle bundles facing the surface to be cleaned to act as edge cleaners. With reference to FIG. 4, cylindrical boss at each end of brushroll 42 can rotate within J-shaped protrusion 62 and thus, end bracket 52 may be pivoted downward relative to front housing 18. Brushroll 42 can now be moved rearwardly, which frees belt 64 from toothed portion 68 of cylindrical roller.

End bracket 52 can be detached from brushroll 42 and cylindrical roller 88 can now be moved laterally out of front housing 18 through retaining slot 170 so that it can be cleaned. In this manner, brush assemblies 38 and 40 may be quickly and easily removed from base unit 10 for cleaning or any other maintenance that may be required.

Referring now to FIGS. 7-11, an alternative second brush assembly 200 is there shown. Brush assembly 200 may be used within base module 10 in place of, for example, second brush assembly 40. Further, brush assembly 200 may be used with or without a first brush assembly. Brush assembly 200 includes a housing 202 adapted to receive a plurality of brushes 204A, 204B, 204C, 204D, 204E, 204F and 204G. Housing 202, which can be of two pieces similar to the embodiment described above, acts as a retaining member retaining the brushes within the base housing. Housing 202 is similar to the housing sections 88 and 90 described above except that housing 202 is configured to house the brushes in two offset rows, therefore, further description of the housing is not provided.

Brushes 204A, 204B, 204C, 204D, 204E, 204F and 204G connect with axial shafts (not visible, but similar to axial shafts 98 in FIG. 5) and the axial shaft of at least one brush (in the present embodiment, brush 204D), includes an extension (not visible, but similar to extension 104) that can operably couple to, and be rotated by, a motor in a similar manner to the embodiment depicted in FIGS. 1-6.

Each brush includes and/or connects to a spur gear similar to spur gear 112 described above, such that when brush 204D is caused to rotate, all other brushes are rotated accordingly. Thus, each brush includes an approximately vertical axis of rotation with respect to the surface being cleaned. Similar to the embodiment described above, the center hub of brushes can each form a hollow downwardly projecting cup 212 having a plurality of openings 214 circumscribing the bottom thereof similar to the embodiment described above.

Each brush 204 includes bristle bundles 224 extending downwardly such that the bristle bundles are adapted to contact a floor surface for example a carpet. The rotating motion of brush 204 draws each bristle bundle 224 along the surface to effect cleaning. Also, stationary bristle bundles 225 may extend downwardly from housing 202 and agitate the carpet as agitator assembly 200 is drawn across the floor. Bristle bundles 224 may be of a soft texture so that when rotating and in contact with the surface being cleaned bristle bundles 224 bend whereby the bottom of projecting cup 212 is in contact with the surface being cleaned. The cleaning solution may then be dispensed through openings 214 and flow directly onto the surface being cleaned.

Gear housing 202 which also acts as a gear guard for example can further include seven spaced apart, integrally molded, cylindrical bearings 206A, 206B, 206C, 206D, 206E, 206F and 206G. Rotatingly received within bearings 206 are axial shafts 208A, 208B, 208C, 208D, 208E, 208F and 208G of gear brushes 204A, 204B, 204C, 204D, 204E, 204F and 204G. The axial shaft of at least one brush gear (in the present embodiment, brush gear 204D), includes an extension 210 that may be coupled to, and rotated by, a motor assembly (not shown).

Each gear brush 204 may be configured as a spur gear having, for example, ten teeth that intermesh, such that when gear brush 204D is caused to rotate, all other gear brushes are rotated accordingly. Thus, each gear brush 204 includes a vertical axis of rotation with respect to the surface being cleaned. Further, the center hub of gear brushes 204 forms a hollow downwardly projecting cup 212 having a plurality of openings 214 circumscribing the bottom thereof.

Each gear tooth 216 has an upper tooth profile 218 and a lower profile 220 which approximates upper profile 218. However, profile 220 is smaller in size and slightly indented from profile 218, forming an offset. Only profiles 218 of gear teeth 216 are intended to drivingly engage the corresponding tooth profile of the adjacent gear brush.

Each gear tooth 216 includes a bristle bundle 224 extending downwardly from lower tooth profile 220. Bristle bundle 224 is adapted to contact a floor surface such as a carpet wherein the rotating motion of gear brush 204 draws each bristle bundle 224 along the surface to effect cleaning. Also, stationary bristle bundles 225 may extend downwardly from the gear guard 202 and agitate the carpet as agitator assembly 200 is drawn across the floor. Bristle bundles 224 may be of a soft texture so that when rotating and in contact with the surface being cleaned bristle bundles 224 bend whereby the bottom of projecting cup 212 is in contact with the surface being cleaned. The cleaning solution may then be dispensed through openings 214 and flow directly onto the surface being cleaned.

Figure 8:
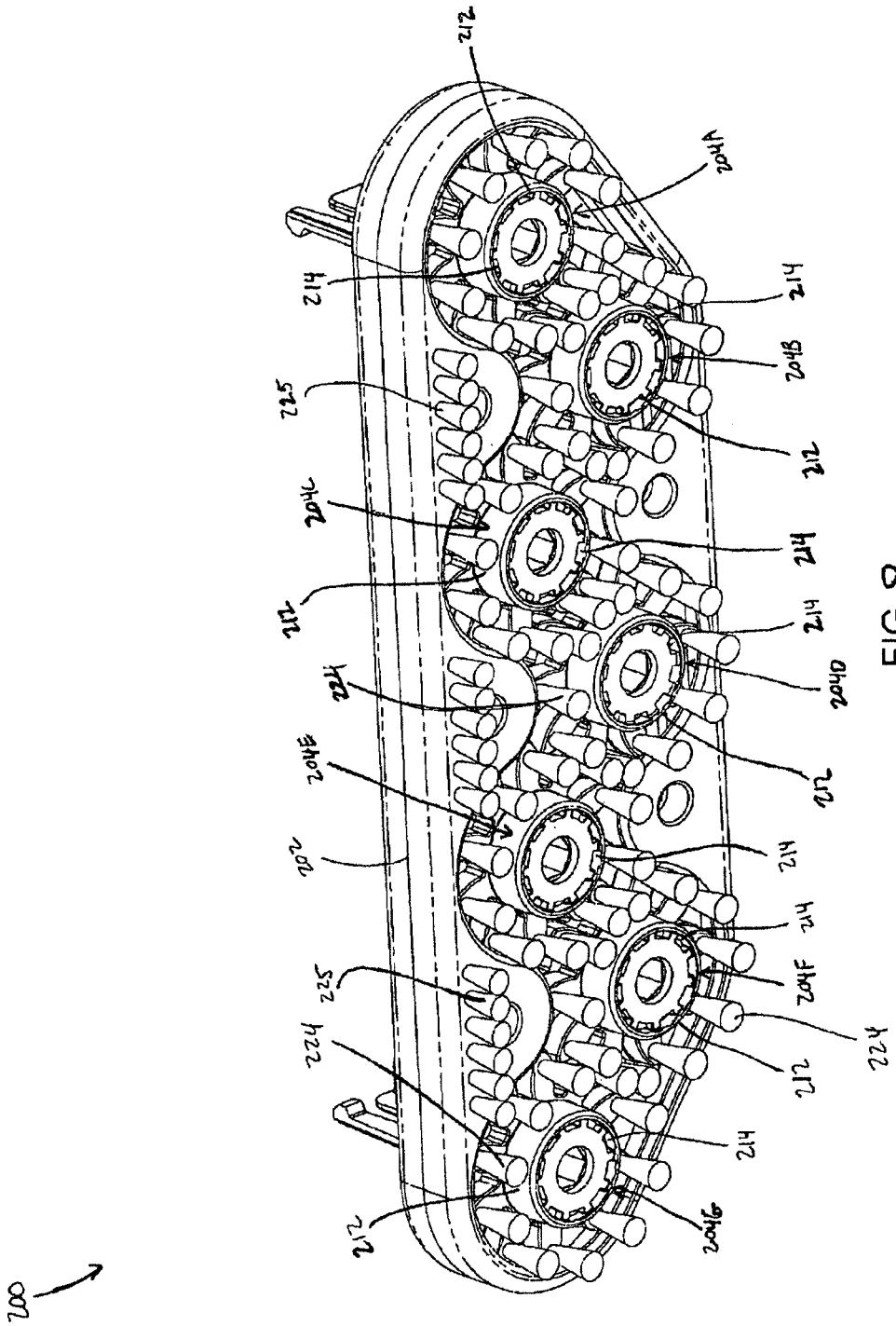
FIG. 8 is a bottom isometric view of the alternative brush assembly of FIG. 7.
Figure 9:
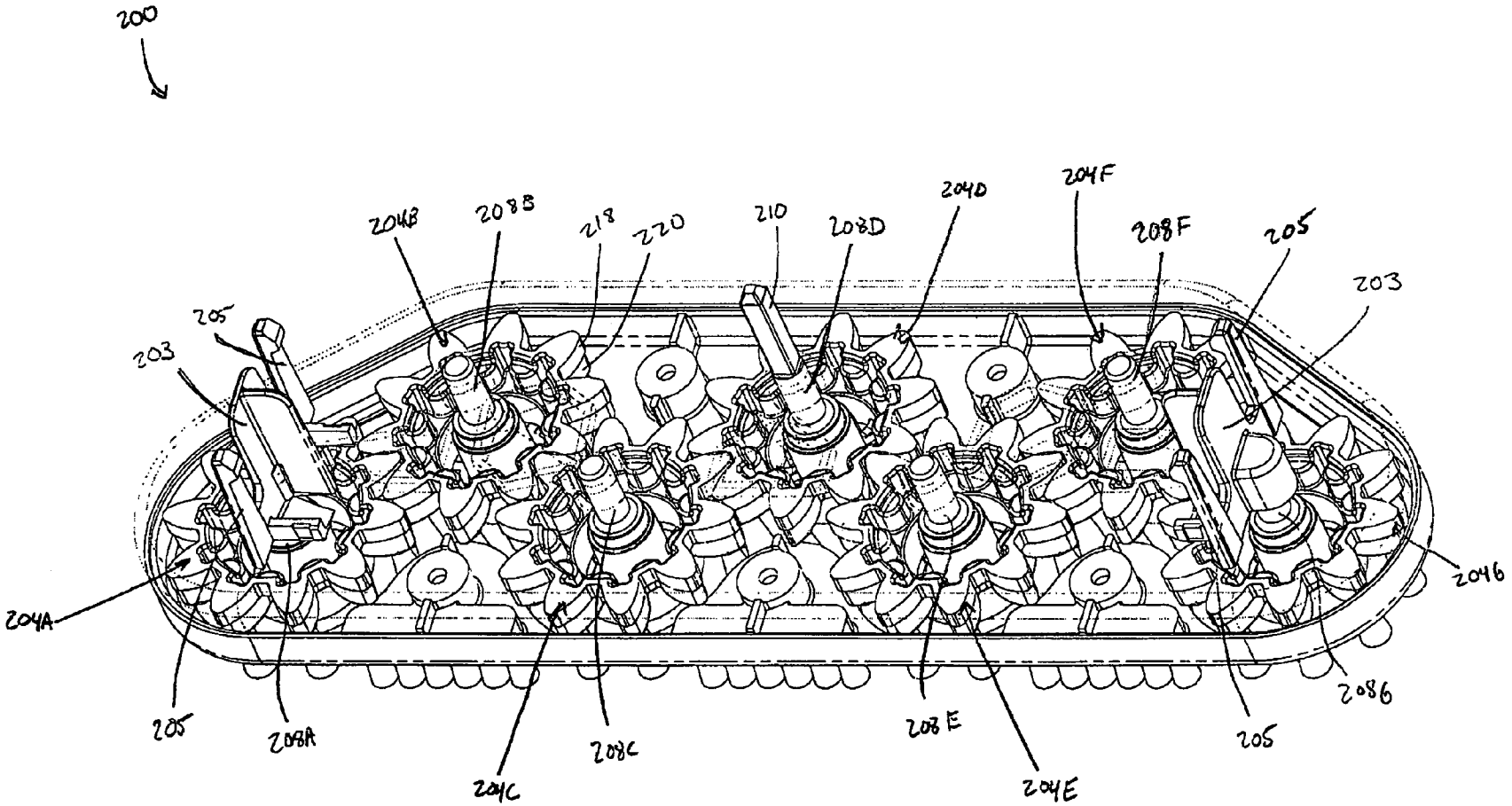
FIG. 9 is a cut-away isometric view of the alternative brush assembly of FIG. 7.

In the embodiment depicted in FIG. 8, brushes are arranged in two offset rows. A front row includes three brushes 204B, 204D and 204F. A rear row includes four brushes 204A, 204C, 204E and 204G. This staggered configuration advantageously results in greater overlap between adjacent gear brushes. This configuration allows the user to clean a carpet in fewer passes, resulting in a time savings.

Figure 16:
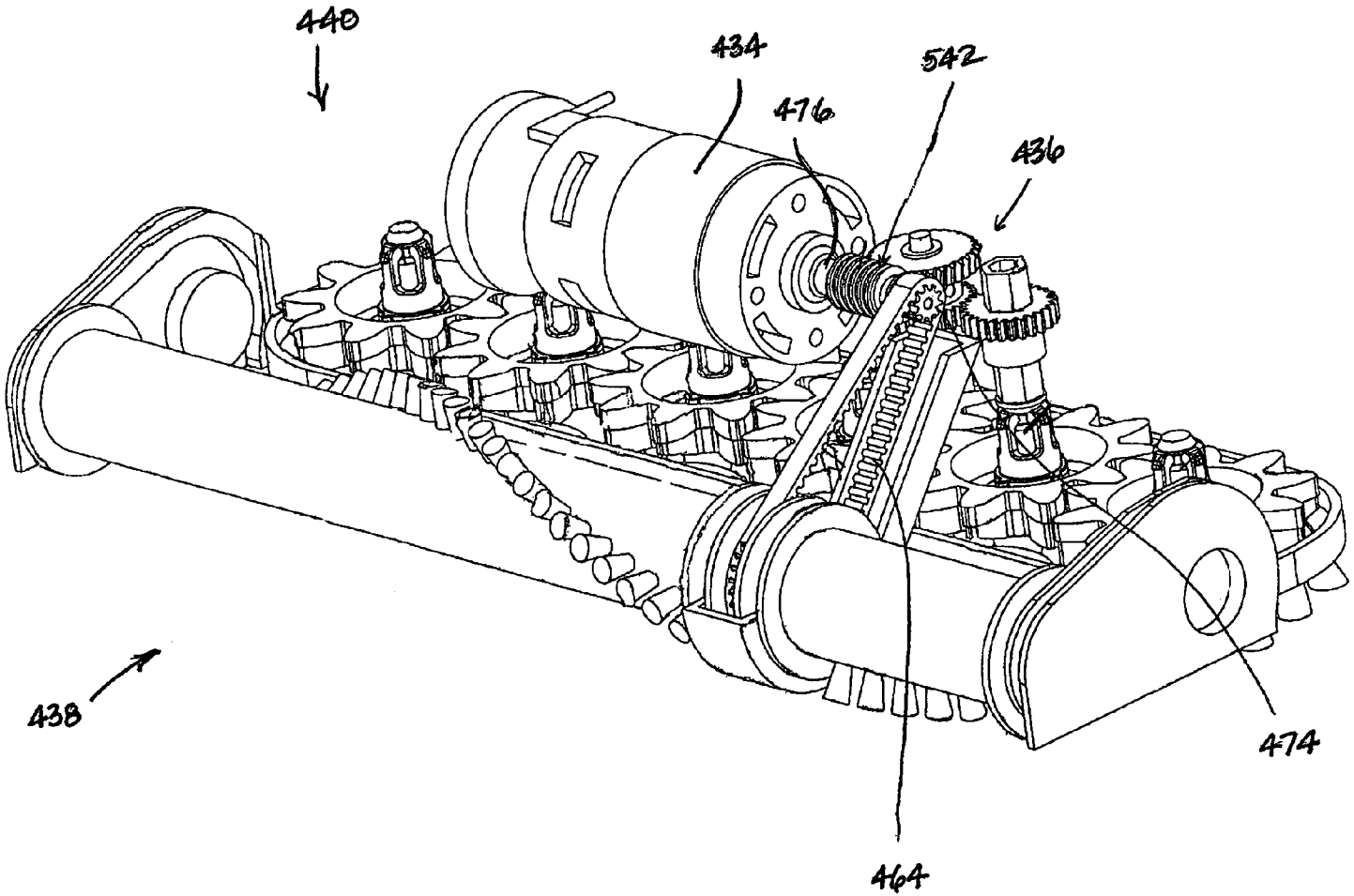
FIG. 16 is an enlarged upper perspective view of the forward side of an alternative embodiment of an agitator assembly according to the present disclosure with a protective housing removed.

Referring now to FIGS. 12-15, another alternative second brush assembly 300 is shown. Brush assembly 300 may also be used in base module 10, in place of second brush assembly 40 disclosed above. Further, alternative brush assembly 300 may be used with or without a first brush assembly. In this embodiment, two brushes (304E and 304K in this embodiment) are directly driven by a motor 313 and the remaining ten brushes 304A, 304B, 304C, 304D, 304F, 304G, 304H, 304I, 304J and 304L are operably connected with these two directly driven brushes. Because of the additional torque required to drive the twelve gear brushes, brush 304E connects with a first extension 310 and brush 304K includes or connects with a second extension 311. Extensions 310 and 311 are coupled to, and rotated by, a motor 313 through respective gear reduction transmissions 326 and 346 and a worm gear 348 similar to the transmission described with particularity in FIG. 3. Alternatively the power transmission mechanism can be like that as shown in FIG. 12 or 16, discussed below, having worm gear 336.

The housing 302 for the gears or gear guard 302 can include a plurality of alignment posts 303 that are received in a vacuum cleaner housing to align and laterally constrain brush assembly 300 relative to a vacuum housing (not shown). Gear guard 302 may further include upwardly extending clips 305 that cooperate with receiving projections (not shown) in a vacuum housing to secure brush assembly 300 thereto. Gear guard 302 further includes twelve spaced apart, integrally molded, cylindrical bearings 306A, 306B, 306C, 306D, 306E, 306F, 306G, 306H, 306I, 306J, 306K and 306L in two aligned rows. Rotatingly received within bearings 306 are axial shafts 308A, 308B, 308C, 308D, 308E, 308F, 308G, 308H, 308I, 308J, 308K and 308L of gear brushes 304A, 304B, 304C, 304D, 304E, 304F, 304G, 304H, 304I, 304J, 304K and 304L. Because of the additional torque required to drive the twelve gear brushes, brush gear 304E includes a first extension 310 and brush gear 304K includes a second extension 311. Extensions 310 and 311 are coupled to, and rotated by, a motor assembly 313 as will be described below.

Each gear brush 304 may be configured as a spur gear having, for example, ten teeth that intermesh, such that when one gear brush 304 rotates, all other gear brushes are rotated accordingly. Thus, each gear brush 304 includes a vertical axis of rotation with respect to the surface being cleaned. Further, the center hub of gear brushes 304 forms a hollow downwardly projecting cup 312 having a plurality of openings 314 circumscribing the bottom thereof.

Each gear tooth 316 has an upper tooth profile 318 and a lower profile 320 which approximates upper profile 318 (see FIG. 13). However, profile 320 is smaller in size and slightly indented from profile 318, forming an offset. Only profiles 318 of gear teeth 316 are intended to drivingly engage the corresponding tooth profile of the adjacent gear brush.

Each gear tooth 316 includes a bristle bundle 324 extending downwardly from lower tooth profile 320. Bristle bundle 324 is adapted to contact a floor surface such as a carpet wherein the rotating motion of gear brush 304 draws each bristle bundle 324 along the surface to effect cleaning. Bristle bundles 324 may be of a soft texture so that when rotating and in contact with the surface being cleaned bristle bundles 324 bend whereby the bottom of projecting cup 212 is in contact with the surface being cleaned. The cleaning solution may then be dispensed through openings 314 and flow directly onto the surface being cleaned.

Figures 14, 15:
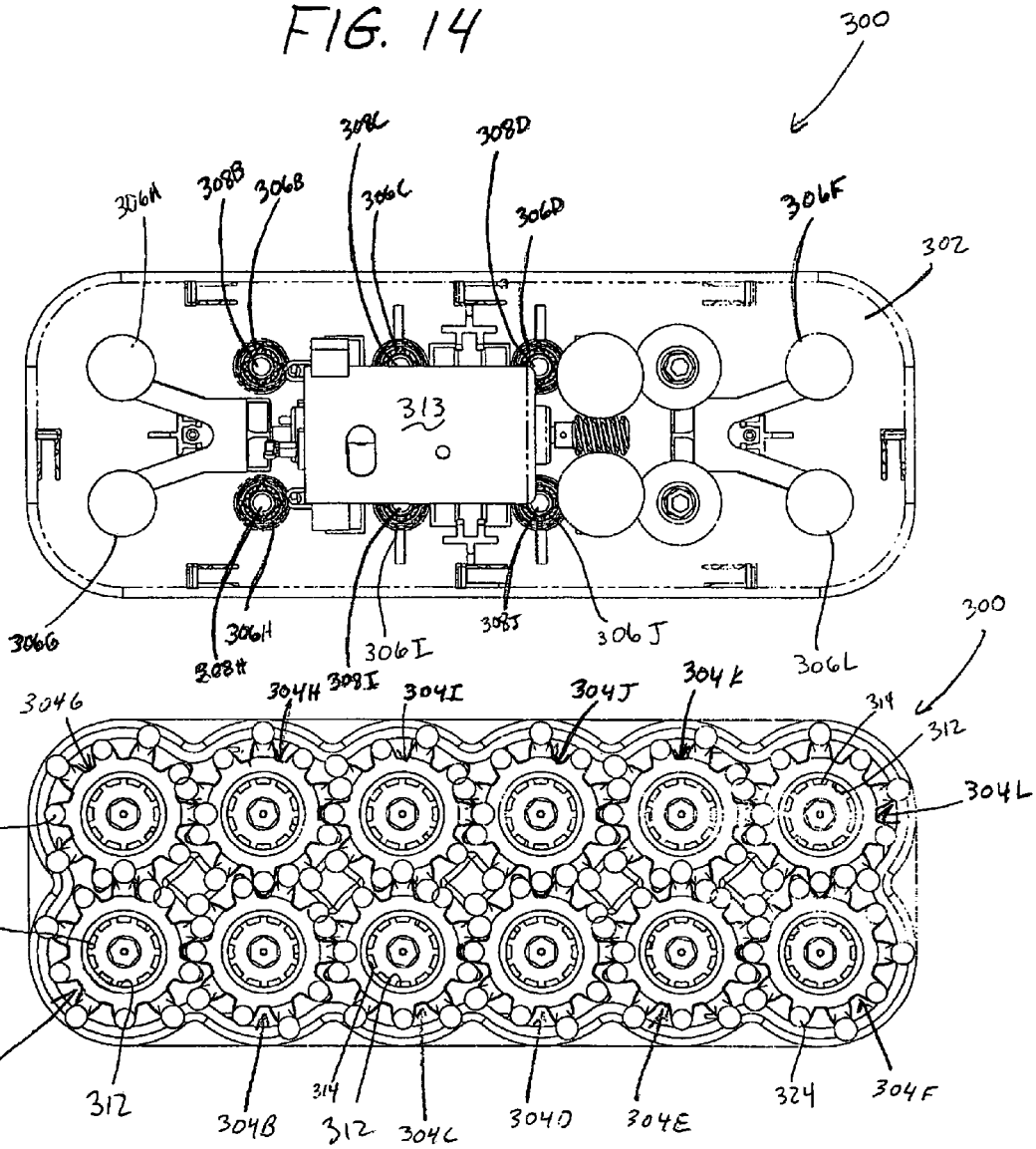
FIG. 14 is a top view of the alternative brush assembly of FIG. 12.
FIG. 15 is a bottom view of the alternative brush assembly of FIG. 12.

As shown in FIG. 15, Brushes 304 are arranged in two aligned rows of side by side brushes 304 in each row. The front and back rows each can include six gear brushes. It should, however, be appreciated that more or less than the disclosed number of brushes 304 may be employed, depending upon performance requirements. Each gear brush 304 intermeshes with the gears directly adjacent thereto. For example, gear brush 304H intermeshes with gear brushes 304B, 304G and 304I. This configuration provides improved cleaning in a relatively small and compact arrangement. Specifically, as the brush assembly 300 is drawn across a floor each carpet area is agitated by at least two gear brushes. This configuration allows the user to clean a carpet in fewer passes, resulting in a time savings.

Referring now to FIG. 16, an alternative embodiment of an agitator assembly where a motor drives a first brush roll assembly and a second brush roll assembly from the same side of the motor is disclosed. This alternative is particularly useful for improved operation of the agitator assembly with the gear brushes as shown in FIGS. 12-15. The first brush assembly 438 is similar to the first brush assembly 38 described above. The second brush assembly 440 is similar to the second brush assembly 40 described above. The first brush assembly 438 is driven by a belt 464 operatively connected to a motor 434. Similarly, second brush assembly 440 is operably connected to motor 434 via a gear reduction transmission 436, which is similar to the gear reduction transmission described above. The difference between the embodiments shown in FIG. 9 and shown in FIG. 3 is that in the embodiment shown in FIG. 9, both spur gear 474, which drives belt 464, and a worm gear 542 are disposed on an output shaft 476 of motor 434 on the same side of the motor. This can provide a more compact arrangement as compared to the power transfer mechanism shown in FIG. 3. The power transfer mechanism shown in FIG. 3, however, can provide a more balanced overall assembly.

A floor cleaning machine has been described with reference to certain embodiments. Modifications and alterations will occur to those upon reading and understanding the detailed description. The invention is not limited to only those embodiments depicted in the preceding description. Instead, the invention is broadly defined by the appended claims and the equivalents thereof.

The invention claimed is:

1. A floor cleaning machine comprising:

a vacuum source;

a base module having a front end and a rear end;

a suction inlet mounted to the base module and in fluid communication with the vacuum source;

a motor mounted to the base module;

a first agitator brush supported by the base module and operably connected to the motor, the first agitator brush rotating about a first axis;

a second agitator brush supported by the base module and operably connected to the motor, the second agitator brush rotating about a second axis which is oriented generally perpendicular to the first axis; and a third agitator brush supported by the base module and operatively interconnected with the second agitator brush such that rotation of the second agitator brush causes rotation of the third agitator brush about a third axis which is oriented generally perpendicular to the first axis and spaced apart from the second axis, wherein the first agitator brush is driven at a first torque and the second agitator brush is driven at a second torque different from the first torque, and wherein the motor drives both the first agitator brush and the second agitator brush, wherein the floor cleaning machine further includes a first transmission on a first side of the motor operatively connecting the motor to the first agitator brush and a second transmission on a second side of the motor operatively connecting the motor to the second agitator brush.

2. The floor cleaning machine of claim 1, wherein the suction inlet is positioned between the first agitator brush and the front end of the base module.

3. The floor cleaning machine of claim 2, wherein the second agitator brush is positioned between the suction inlet and the rear end.

4. The floor cleaning machine of claim 1, wherein the first agitator brush is positioned between the front end of the base module and the second agitator brush.

5. The floor cleaning machine of claim 1, wherein operation of the second agitator brush is independent of a direction of movement of the base housing.

6. The floor cleaning machine of claim 1, wherein the second transmission includes a gear reduction transmission, wherein the gear reduction transmission operatively connects the second agitator brush to the motor.

7. The floor cleaning machine of claim 6, wherein the first transmission includes a belt, wherein the belt operatively connects the first agitator brush with the motor.

8. The floor cleaning machine of claim 7, the second transmission includes a worm gear and the first transmission includes a spur gear.

9. A floor cleaning machine comprising:

a vacuum source;

a suction nozzle including a suction inlet in fluid communication with the vacuum source;

a base housing supporting the suction nozzle, the base housing having a front end and a rear end;

a motor mounted to the base housing;

a first agitator brush supported by the base module and operably connected to the motor, the first agitator brush rotating about a first axis;

a second agitator brush supported by the base module and operably connected to the motor, the second agitator brush rotating about a second axis which is oriented generally perpendicular to the first axis;

a third agitator brush supported by the base module and operatively interconnected with the second agitator brush such that rotation of the second agitator brush causes rotation of the third agitator brush about a third axis which is oriented generally perpendicular to the first axis and spaced apart from the second axis; and a first transmission on a first side of the motor operatively connecting the motor to the first agitator brush and a second transmission on a second side of the motor operatively connecting the motor to the second agitator brush, wherein the motor drives both the first agitator brush and the second agitator brush.

10. The floor cleaning machine of claim 9, wherein the first agitator brush is driven at a first torque and the second agitator brush is driven at a second torque greater than the first torque.

11. The floor cleaning machine of claim 9, wherein the first agitator brush is disposed between the front end of the base housing and the second agitator brush.

12. The floor cleaning machine of claim 9, wherein the suction inlet is disposed between the front end and the brushes.

13. The floor cleaning machine of claim 9, further comprising a first retaining member releasably connected with the base housing and a second retaining member releasably connected with the base housing, the first agitator brush being rotatably connected to the first retaining member and the second agitator brush being rotatably connected to the second retaining member.

* * * * *